United States Patent [19]

Sung

[11] 4,419,105

[45] Dec. 6, 1983

[54] MALEIC ANHYDRIDE-AMINE REACTION PRODUCT CORROSION INHIBITOR FOR ALCOHOLS

[75] Inventor: Rodney L. Sung, Fishkill, N.Y.

[73] Assignee: Texaco Inc., White Plains, N.Y.

[21] Appl. No.: 359,454

[22] Filed: Mar. 18, 1982

[51] Int. Cl.[3] ..... C10L 1/02; C10L 1/18; C10L 1/22

[52] U.S. Cl. ..... 44/53; 44/71; 44/72; 44/73; 208/47; 252/392; 562/564

[58] Field of Search ..... 252/392; 44/53, 73, 44/72, 71; 208/47; 562/564

[56] References Cited

U.S. PATENT DOCUMENTS

| | | | |
|---|---|---|---|
| 3,780,100 | 12/1973 | Scanlon et al. | 562/564 |
| 4,115,105 | 9/1978 | Scannell et al. | 562/564 |
| 4,144,034 | 3/1979 | Cummings | 252/392 |
| 4,207,079 | 6/1980 | Herbstman et al. | 252/392 |
| 4,348,210 | 9/1982 | Sung | 252/392 |
| 4,392,866 | 7/1983 | Sung | 252/392 |
| 4,392,867 | 7/1983 | Sung | 252/392 |

*Primary Examiner*—Irwin Gluck

*Attorney, Agent, or Firm*—Carl G. Ries; Robert A. Kulason; Carl G. Seutter

[57] ABSTRACT

Alcohols may be inhibited against corrosion by addition thereto of a reaction product of a maleic anhydride and certain amines typified by alkyl isopropoxy aminopropyl amines.

42 Claims, No Drawings

MALEIC ANHYDRIDE-AMINE REACTION PRODUCT CORROSION INHIBITOR FOR ALCOHOLS

FIELD OF THE INVENTION

This invention relates to alcohol products particularly characterized by decreased ability to corrode metal surfaces with which they come into contact.

BACKGROUND OF THE INVENTION

As is well known to those skilled in the art, alcohols such as ethanol may corrode metal surfaces with which they come into contact. This is particularly true of crude or commercially available ethanols which undesirably contain acidic components, commonly acetic acid. In the case of fermentation alcohols, acetic acid may be present in amount of 0.003 wt. %–0.005 wt. % of the alcohol; and this may be responsible for the fact that the alcohol causes serious corrosion problems.

It is an object of this invention to provide a novel process for decreasing the corrosion of alcohol compositions. Other objects will be apparent to those skilled in the art.

STATEMENT OF THE INVENTION

In accordance with certain of its aspects, the novel composition of this invention may comprise (i) at least one water-soluble alcohol preferably selected from the group consisting of ethanol and methanol; and (ii) an effective corrosion-inhibiting amount of the reaction product of a maleic anhydride and an amine $$R(OR')_x[NH\ R'')_a(OR''')_{y(1-a)}]NH_2$$

wherein

R is a $C_1$–$C_{20}$ alkyl, alkaryl, aralkyl, aryl, cycloalkyl, or alkenyl hydrocarbon group;

R′, R″, and R‴ are each a $C_2$–$C_5$ alkylene hydrocarbon group;

a is an integer 0–1;

x is 1–20; and y is 1–20.

DESCRIPTION OF THE INVENTION

The alcohol compositions which may be treated by the process of this invention may include alkanols such as water-soluble alkanols most commonly including $C_1$–$C_4$ alcohols. Preferably, the alcohols include methanol, ethanol, propanols, etc. The alcohols may include mixtures of such alcohols with each other and/or with other compositions including ketones, esters, hydrocarbons, etc. The alcohol may be in the form of gashol—a mixture commonly containing 80v%–95v%, say 90% gasoline and 5v%–20v%, say 10v% alcohol. The alcohol may contain water, for example up to 10w%–20w%, typically 5w%; but preferably it will be anhydrous. Anhydrous compositions commonly contain less than about 0.3v% water, typically 0.001v%–0.005v%, say about 0.004v% water. One preferred charge may be 100% anhydrous ethanol. Another preferred charge may be 100% anhydrous methanol.

Commercially available mixtures may be employed. Illustrative of one such commercially available mixture may be that having the following typical analysis:

TABLE I

| Component | Parts |
|---|---|
| ethanol | 3157.2 |
| methyl isobutyl ketone | 126.3 |
| acetic acid | 0.256 |
| methyl alcohol | 0.24 |
| isopropyl alcohol | 0.2 |
| n-propyl alcohol | 0.162 |
| ethyl acetate | 0.2 |

It is a particular feature of the process of this invention that it may be used to treat such compositions when they are to be used as fuels including gasohols supra.

The fuels to be treated by the process of this invention may be substantially anhydrous i.e. they contain less than about 0.3v% water; typically they may contain 0.001v%–0.005v%, say about 0.004v% water.

It is a feature of these fuels that they may undesirably contain acidic contaminants which may cause serious corrosion problems. These contaminants are particularly in evidence when the alcohol is a commercially available alcohol which contains therein inter alia acids concurrently produced as by fermentation processes for producing ethanol or acids which have been picked up during handling. Acetic acid is a common acid present in the commercially available alcohols produced by fermentation; and it may be present in amount of 0.003v%–0.005w% of the total of the alcohol.

In accordance with practice of the process of this invention, there may be added to the alcohol a minor effective corrosion-inhibiting amount of, as a corrosion inhibiting agent, the reaction product of a maleic anhydride and $$R(OR')_x[(NH\ R'')_a(OR''')_{y(1-a)}]NH_2$$

wherein

R is a $C_1$–$C_{20}$ alkyl, alkaryl, aralkyl, aryl, cycloalkyl, or alkenyl hydrocarbon group;

R′, R″ and R‴ are each a $C_2$–$C_5$ alkylene hydrocarbon group;

a is an integer 0–1;

x is 1–20; and y is 1–20.

The maleic anhydride which may be used in practice of the process of this invention may be maleic anhydride se, or a substituted maleic anhydride such an alkyl maleic anhydride, typically a $C_1$–$C_{12}$ alkyl maleic anhydride such as methyl maleic anhydride, ethyl maleic anhydride, etc. The preferred composition is maleic anhydride se.

The amines which may be employed in one embodiment (when a is 1) may be characterized by the formula:

$$R(OR')_xNH\ R''NH_2$$

wherein

R is a $C_1$–$C_{20}$ alkyl hydrocarbon group;

R′ is a $C_2$–$C_5$ alkylene hydrocarbon group;

R″ is a $C_2$–$C_5$ alkylene hydrocarbon group;

and x is 1–20.

In the above formula, R may be an alkyl, aralkyl (such as benzyl), alkaryl (such as tolyl), aryl (such as phenyl), cycloalkyl (such as cyclohexyl), or alkenyl (such as allyl). Preferably, however, R may be an alkyl hydrocarbon group containing 1–20, preferably 10–16, say 13 carbon atoms. R may for example be methyl, ethyl, propyl, isopropyl, butyls, amyls, hexyls including cyclohexyl, octyls, decyls, dodecyls, tridecyls, etc. The preferred R may be tridecyl $C_{13}H_{27}$—. Commercially available mixtures of isomers may be employed, such as that containing a mixture wherein R is derived from a mixture of $C_{12}$ and $C_{14}$ normal alkyl.

R′ and R″ may be alkylene hydrocarbon groups containing 2–5 carbon atoms, typified by ethylene, propylene, butylene, pentylene, etc. The preferred R′ and R″ groups may be those containing 2–3 groups —$CH_2CH_2$— and $$-CH_2\underset{\underset{CH_3}{|}}{CH}-$$

and —$CH_2CH_2CH_2$—. The preferred R″ group may be —$CH_2CH_2CH_2$—.

Illustrative amine compositions which may be employed may include the following, the first listed being the preferred:

TABLE

| | |
|---|---|
| A. | $C_{13}H_{27}OCH_2CH_2CH_2NHCH_2CH_2CH_2NH_2$ |
| B. | $C_6H_{13}O(CH_2)_3NH(CH_2)_3NH_2$ |
| C. | $C_9H_{19}O(CH_2)_2NH(CH_2)_3NH_2$ |
| D. | $C_{12}H_{25}O(CH_2)_3NH(CH_2)_3NH_2$ |
| E. | $C_{13}H_{27}(OCH_2-\underset{\underset{CH_3}{\vert}}{CH})NH(CH_2)_3NH_2$ |

These amines may be available commercially as pure compositions or more commonly as mixtures of isomers which may be used as available. A preferred commercially available product may be the Tomah DA-17 brand of the preferred tridecyl oxypropyl aminopropyl amine.

In another embodiment (when a is zero), the amines may have the formula $R(OR')_x(OR''')_yNH_2$ wherein R is a $C_1$–$C_{20}$ an alkyl, aralkyl (such as benzyl), alkaryl (such as tolyl), aryl (such as phenyl), cycloalkyl (such as cyclohexyl), or alkenyl (such as allyl). Preferably, however, R may be an alkyl hydrocarbon group;

R′ is a $C_2$–$C_5$ alkylene hydrocarbon group;

R‴ is a $C_2$–$C_5$ alkylene hydrocarbon group;

x is 1–20; and y is 1–20.

The R and R′ groups may selected from the same groups as noted supra for R and R′. R‴ may be selected from the same group as that from which R′ is selected; and in a molecule R‴ will be different from R′.

Illustrative compositions of this type which may be employed may include the following:

TABLE

| | |
|---|---|
| F. | $C_{10}H_{21}(OCH_2\underset{\underset{CH_3}{\vert}}{CH})_3(OCH_2\underset{\underset{CH_3}{\vert}}{CH})NH_2$ |
| G. | $C_4H_9(OCH_2CH_2)_x(OCH_2\underset{\underset{CH_3}{\vert}}{CH})NH_2$ |
| H. | $CH_3(OCH_2CH_2)(OCH_2\underset{\underset{CH_3}{\vert}}{CH})_8NH_2$ |
| I. | $CH_3(OCH_2CH_2)_{19}(OCH_2\underset{\underset{CH_3}{\vert}}{CH})_2NH_2$ |

These amines may be available commercially as pure compositions or more commonly as mixtures of isomers. A preferred commercially available product may be the Jeffamine® M-300 brand of $$(C_{10}\text{–}C_{12})\ (OCH_2\underset{\underset{CH_3}{\vert}}{CH})\ (OCH_2\underset{\underset{CH_3}{\vert}}{CH})\ NH_2$$

prepared from a commercially mixture of $C_{10}$–$C_{12}$ alcohols.

Reaction of the amine and the maleic acid anhydride may be effected in the absence of catalyst by adding 100–200 parts, say 147 parts of the maleic anhydride to 600–800 parts, say 720 parts of an inert solvent. Inert solvent may include hydrocarbon oils typically xylene, 100E pale oil, etc. The mixture is preferably heated to 30°–60° C., say 55° C. at atmospheric pressure as the anhydride dissolves in the solvent.

There may then be added 500–700 parts, say 600 parts of amine corresponding to a mole ratio of amine:acid of 1.8–3, say 2:1. If the desired product is that corresponding to a 1:1 mole ratio, clearly the amount of added amine will be one mole per mole of maleic anhydride. The amine is added slowly over 30–60 minutes, say 60 minutes as the reaction mixture is maintained at 80° C.–100° C., say 100° C. Total time of reaction is commonly 30–60 minutes, say 60 minutes.

The reaction mixture on cooling may be found to have a total base number (TBN) of 100–250, say 210.3, a total acid number (TAN) of 60–100, say 97.4, and a nitrogen content of 6w%–7w%, say 7.49w% (for a 2:1 amine to maleic anhydride product).

It appears that during a typical reaction for the 2:1 mole ratio the following may occur:

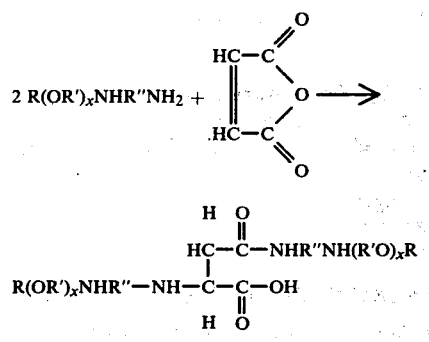

wherein R is typically tridecyl.

In the case of the 1:1 mole ratio, the reaction may typically be

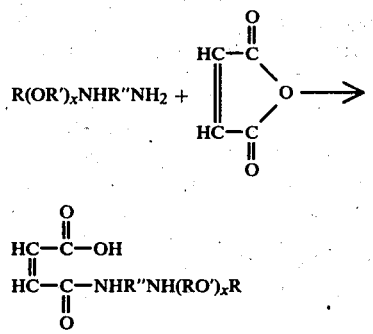

It will be apparent to those skilled in the art that the above compounds may be neutralized by the transfer of a proton from the carboxyl group to a nitrogen atom in the same or a different molecule. Although for the sake of convenience, and simplicity these formulae may be written in Zwitterion form, the compounds may in fact be present as quaternaries typified by

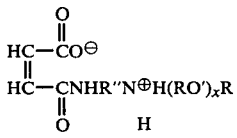

or

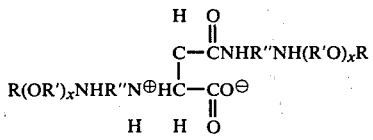

See eg. U.S. Pat. No. 4,144,034 to Texaco as assignee of Cummings, U.S. Pat. No. 4,207,079 to Texaco as assignee of Herbstman etal, etc.

In the case of the amines having the formula R $(OR')_x$ $(OR''')_yNH_2$ the reaction (for the 1:1 mole ratio)

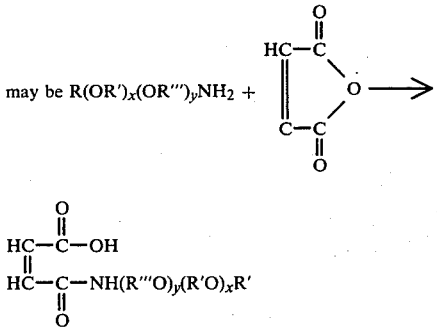

In the case of the 2:1 mole ratio, the reaction may be

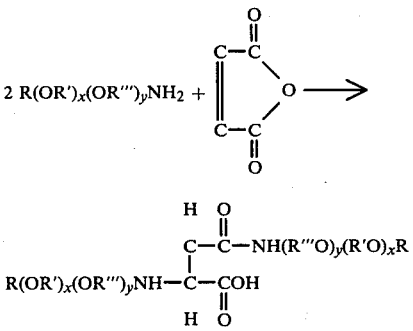

As is well known, these asparagine compounds (qv U.S. Pat. No. 2,207,079) may exist in Zwitterion forms—the proton of the —COOH can neutralize a basic nitrogen atom.

Preferred reaction products may be those obtained by the reaction of:

TABLE

1. One mole of maleic anhydride and two moles of the A amine of the Table supra;
2. One mole of maleic anhydride and one mole of the A amine of the Table supra;

TABLE-continued

3. One mole of methyl maleic anhydride and 2.2 moles of the A amine of the Table supra;
4. One mole of maleic anhydride and 2.2 moles of the B amine of the Table supra;
5. One mole of methyl maleic anhydride and 1.9 moles of the A amine of the Table supra.
6. One mole of maleic anhydride and 1.9 moles of the A amine of the Table supra;
7. One mole of maleic anhydride and one mole of the B amine of the Table supra.
8. One mole of maleic anhydride and one mole of the Jeffamine ® M-300 composition

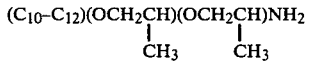

9. One mole of maleic anhydride and one mole of the F amine of the Table supra;
10. One mole of maleic anhydride and two moles of the F amine of the Table supra;
11. One mole of maleic anhydride and one mole of the G amine of the Table supra;
12. One mole of maleic anhydride and two moles of the G amine of the Table supra.

The preferred reaction product may be the first listed in the immediately preceding table.

The so prepared rust and corrosion inhibitors may be added to an alkanol in minor corrosion-inhibiting amount of 10–200, preferably 25–150 PTB, more preferably 25–100 PTB, say 50 PTB. (PTB stands for pounds of additive per thousand barrels of alcohol or fuel). Alternatively expressed, the inhibitor may be added in approximate amounts of 0.004–0.08w%, preferably 0.01–0.06w%, more preferably 0.01–0.04w%, say about 0.04w%. Larger amounts may be employed, but may not be necessary.

It is a feature of this invention that the alcohol composition so prepared is characterized by its increased corrosion and rust inhibition i.e. its decreased ability to form rust on iron surfaces in the presence of aqueous acid systems.

The corrosive nature of the formulated products may be readily measured by the Iron Strip Corrosion Test (ISCT). In this test, an iron strip (12 mm×125 mm×1 mm) is prepared by washing in dilute aqueous hydrochloric acid to remove mill scale, then with distilled water to remove the acid, then with acetone-followed by air drying. The strip is then polished with #100 emery cloth.

The polished strip is totally immersed in 90 ml of the test liquid in a 4 ounce bottle for 15 minutes at room temperature of 20° C. 10 ml of distilled water is added. The bottle is shaken the sample is maintained for 3 days at room temperature of 90° F. The percent rust on the strip is determined visually.

The inhibited alcohols of this invention, after 3 days of ISCT, generally show a Rust and Corrosion rating below about 2–3% and frequently as low as trace-to-1%.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I

In this Example, there are charged to a reaction vessel 400 parts of xylene and 10.6 parts of maleic acid anhydride. The mixture is heated to 90° C.–95° C.; and there are added 68.4 parts of the Tomah DA-17 brand of tridecyl oxypropyl amino isopropyl amine.

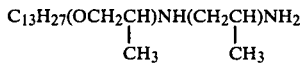

The reaction mixture is maintained at 100° C. for 2 hours and it is then filtered and stripped of maleic acid anhydride. The product is analyzed by elemental analysis, infra-red, and by $C^{13}$ NMR.

This 1:1 product corresponds to

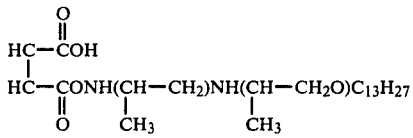

probably in equilibrium with its Zwitterion salt—the carboxyl proton being located on a nitrogen atom. NB. U.S. Pat. No. 4,144,034 to Texaco as assignee of Cummings or U.S. Pat. No. 4,207,079 as assignee of Herbstman etal.

EXAMPLE II

In this example, the procedure of Example I is followed except that the Tomah DA-17 amine is added in amount of 136.8 parts corresponding to a mole ratio of 2:1 of amine to anhydride.

The product corresponds to the formula

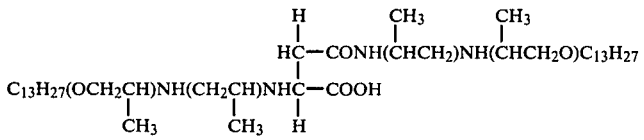

probably in equilibrium with its Zwitterion salt.

The products of Examples I and II were tested in amount of 100 PTB (pounds per thousand barrels) in the alcohol of Table I supra.

In control Example III*, the test was carried out using 200 PTB of a prior art composition—polyisobutenyl ($\overline{M}_n$ 1290) succinic acid (50% active—contains 50% diluent oil).

In control Example IV*, the test was carried out using only the alcohol of Table I with no additive.

The Iron Strip Corrosion Test was carried out and the % rust determined after three days. The results were as follows:

TABLE

| Example | PTB | ISCT Rating % Rust at 3 Days |
|---|---|---|
| I | 100 | 1-5% |
| II | 100 | 0% |
| III* | 200 | 0% |
| IV* | — | 50% |

From the above table, it is apparent that the preferred embodiment of Example II when used in amount of only 100 PTB is as satisfactory as the prior art control of Example III at 200 PTB. The less preferred embodiment of Example I is only slightly less satisfactory than the preferred.

EXAMPLE V

In this example, there may be charged to a reaction vessel 400 parts of xylene and 98 parts of maleic acid anhydride. The mixture is heated to 90°–95° C. and there may be added 289.5 parts of the Jeffamine® M-300 brand of

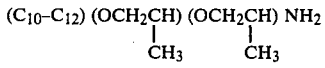

The ($C_{10}$–$C_{12}$) is derived from a mixture of linear alkyl groups having 10 and 12 carbon atoms.

The reaction mixture is maintained at 100° C. for 2 hours and it is then filtered and stripped of maleic acid anhydride. The product is analyzed by elemental analysis, infra-red and by $C^{13}$ NMR.

The product corresponds to

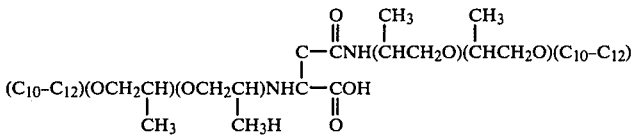

probably as its Zwitterion.

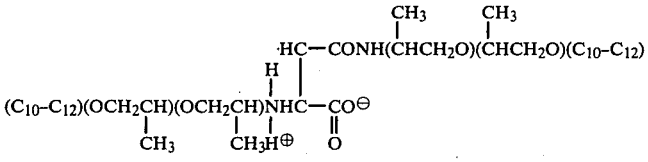

The product of Example V was tested in amount of 25 PTB of active material in the alcohol of Table I.

In control Example VI*, the test was carried out by adding to the same alcohol (in amount of 100 PTB) a prior art commercial corrosion inhibitor for gasoline—the Arquad 12-15 brand of trimethyl, dodecylammonium chloride.

In control Example VII*, the test was carried out on a blank—i.e. the same alcohol with no additive.

The Iron Strip Corrosion Test was carried out and the % rust determined after five days. The results were as follows:

TABLE

| Example | PTB | ISCT Rating % Rust at 5 Days |
|---|---|---|
| V | 25 | 5-10% |
| VI* | 100 | 100% (after 2 hrs.) |
| VII* | — | 30% |

It should be noted that the control of Example VII* showed a 5-day rating of 30% while that of Example IV* showed a 3-day rating at 50%. This is because the various samples of charge alcohol are not identical—although in a series of comparative examples (such as Examples I-IV or Examples V-VII) the same alcohol examples were used and thus the data within each series is correlative.

Results comparable to those of Examples I or II may be obtained if the additive is formed from the following substituted anhydrides (rather than from maleic acid anhydride):

| Example | Additive-Anhydride |
|---|---|
| VIII | citraconic |
| IX | itaconic |
| X | ethylmaleic |
| XI | chloromaleic |

Results comparable to those of Examples I or II may be obtained if the amine reactant is:

| Example | Reactant |
|---|---|
| XII | $C_4H_9(OCH_2CH_2)_4(OCH_2\overset{\overset{CH_3}{\vert}}{C}H)_2NH_2$ |
| XIII | $CH_3OCH_2CH_2O(CH_2\overset{\overset{CH_3}{\vert}}{C}HO)_8CH_2\overset{\overset{CH_3}{\vert}}{C}HNH_2$ |
| XIV | $C_{10}H_{21}OCH_2CH_2CH_2NHCH_2CH_2CH_2NH_2$ |

Results comparable to those of Example I may be obtained if the alcohol is as follows:

| Example | Fuel |
|---|---|
| XV | absolute ethanol |
| XVI | absolute methanol |
| XVII | Gasohol containing 90v% gasoline and 10v% absolute ethanol |

Although this invention has been illustrated by reference to specific embodiments, it will be apparent to those skilled in the art that various changes and modifications may be made which clearly fall within the scope of this invention.

I claim:

1. A composition comprising (i) a water-soluble alcohol; and (ii) an effective corrosion-inhibiting amount of the reaction product of a maleic acid anhydride and an amine having the formula $$R(OR')_x[NH\ R'')_a(OR''')_{y(a-1)}]NH_2$$

wherein

R is a $C_1$-$C_{20}$ alkyl, alkaryl, aralkyl, aryl, cycloalkyl, or alkenyl hydrocarbon group;

R', R'' and R''' are each a $C_2$-$C_5$ alkylene hydrocarbon group;

a is an integer 0-1 x is 1-20; and y is 1-20.

2. A composition comprising (i) a water-soluble alcohol; and (ii) an effective corrosion-inhibiting amount of the reaction product of a maleic acid anhydride and an amine having the formula $$R(OR')_xNHR''NH_2$$

wherein

R is a $C_1$-$C_{20}$ alkyl, alkaryl, aralkyl, aryl, cycloalkyl, or alkenyl hydrocarbon group;

R' is a $C_2$-$C_5$ alkylene hydrocarbon group;

R'' is a $C_2$-$C_5$ alkylene hydrocarbon group; and

X is 1-20.

3. A composition as claimed in claim 2 wherein R is a $C_{10}$-$C_{12}$ alkyl hydrocarbon.

4. A composition as claimed in claim 2 wherein R is a $C_1$-$C_4$ alkyl hydrocarbon group.

5. A composition as claimed in claim 2 wherein R is a methyl group.

6. A composition as claimed in claim 2 wherein R' is a $C_2$-$C_3$ hydrocarbon group.

7. A composition as claimed in claim 2 wherein R' is $—CH_2CH_2—$.

8. A composition as claimed in claim 2 wherein R' is $$—CH_2—\underset{\underset{CH_3}{\vert}}{C}H—$$

9. A composition as claimed in claim 2 wherein R'' is a $C_2$-$C_3$ hydrocarbon group.

10. A composition as claimed in claim 2 wherein R'' is $—CH_2CH_2—$.

11. A composition as claimed in claim 2 wherein R'' is $$—CH_2—\underset{\underset{CH}{\vert}}{C}H—$$

12. A composition as claimed in claim 2 wherein said amine is $$C_{13}H_{27}(OCH_2\underset{\underset{CH_3}{\vert}}{C}H)NHCH_2\underset{\underset{CH_3}{\vert}}{C}HNH_2$$

13. A composition as claimed in claim 2 wherein said alcohol is ethanol.

14. A composition as claimed in claim 2 wherein said alcohol is a gasohol.

15. A composition as claimed in claim 2 wherein said reaction product is present in effective corrosion-inhibiting amount of 10–200 pounds per thousand barrels of alcohol.

16. A composition as claimed in claim 2 wherein said reaction product has the formula

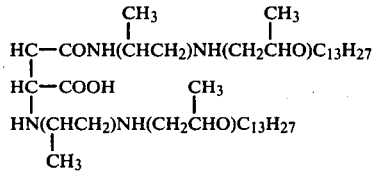

17. A composition comprising ethanol and 25–100 pounds per thousand barrels of ethanol of the reaction product of maleic acid anhydride and $$R(OR')_xNHR''NH_2$$

wherein

R is a $C_1$–$C_{20}$ alkyl, alkaryl, aralkyl, aryl, cycloalkyl, or alkenyl hydrocarbon group;

R′ and R″ are each a $C_2$–$C_5$ alkylene hydrocarbon group;

and is 1–20.

18. The method of treating a composition containing at least one alcohol selected from the group consisting of ethanol and methanol which comprises adding to said composition an effective corrosion-inhibiting amount of the reaction product of a maleic acid anhydride and an amine $$R(OR')_xNHR''NH_2$$

wherein

R is a $C_1$–$C_{20}$ alkyl, alkaryl, aralkyl, aryl, cycloalkyl, or alkenyl hydrocarbon group;

R′ is a $C_2$–$C_5$ alkylene hydrocarbon group;

R″ is a $CH_2$–$C_5$ alkylene hydrocarbon group; and x is 1–20.

19. A composition comprising (i) a water-soluble alcohol; and (ii) an effective corrosion-inhibiting amount of the reaction product of one mole of a maleic acid anhydride and about two-moles of an amine $R(OR')_x(OR'')_yNH_2$ wherein R is a $C_1$–$C_{20}$ alkyl, alkaryl, aralkyl, aryl, cycloalkyl, or alkenyl hydrocarbon group;

R′ and R‴ are each a $C_2$–$C_5$ alkylene hydrocarbon group;

x is 1–20; and y is 1–20.

20. A composition as claimed in claim 19 wherein R is a $C_{10}$–$C_{12}$ alkyl hydrocarbon.

21. A composition as claimed in claim 19 wherein R is a $C_1$–$C_4$ alkyl hydrocarbon group.

22. A composition as claimed in claim 19 wherein R is a methyl group.

23. A composition as claimed in claim 19 wherein R′ is a $C_2$–$C_3$ hydrocarbon group.

24. A composition as claimed in claim 19 wherein R′ is $—CH_2CH_2—$.

25. A composition as claimed in claim 19 wherein R′ is

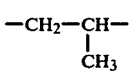

26. A composition as claimed in claim 19 wherein R″ is a $C_2$–$C_3$ alkylene hydrocarbon group.

27. A composition as claimed in claim 19 wherein R″ is $—CH_2CH_2—$.

28. A composition as claimed in claim 19 wherein R″ is

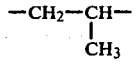

29. A composition as claimed in claim 19 wherein said amine is

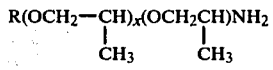

R is a mixture of linear $C_{10}$–$C_{12}$ alkyl hydrocarbon groups and x has an average value of about 1.

30. A composition as claimed in claim 19 wherein said alcohol is ethanol.

31. A composition as claimed in claim 19 wherein said alcohol is a gasohol.

32. A composition as claimed in claim 19 wherein said reaction product is present in effective corrosion-inhibiting amount of 10–200 pounds per thousand barrels of alcohol.

33. A composition as claimed in claim 19 wherein said reaction product has the formula

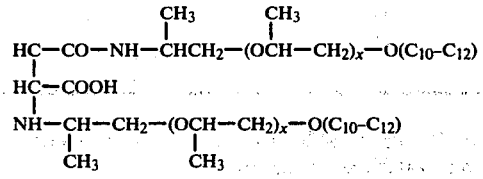

34. A composition comprising ethanol and 10–200 pounds per thousand barrels of ethanol of the reaction product of one mole of maleic acid anhydride and about two moles of

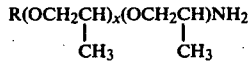

wherein R is a mixture of $C_{10}$–$C_{12}$ alkyl hydrocarbon groups and x has an average value of about 1.

35. The method of treating a composition containing at least one alcohol selected from the group consisting of ethanol and methanol which comprises adding to said composition an effective corrosion-inhibiting amount of the reaction product of one mole of maleic acid anhydride and about two moles of $$R(OR')_x(OR'')_yNH_2$$

wherein

R is a $C_1$–$C_{20}$ alkyl, alkaryl, aralkyl, aryl, cycloalkyl, or alkenyl hydrocarbon group;

R′ and R‴ are each a $C_2$–$C_5$ alkylene hydrocarbon group;

x is 1–20; and y is 1–20.

36. A composition comprising the reaction product of a maleic acid anhydride and an amine having the formula:

$$R(OR')_x[(NHR'')_a(OR''')_{y(1-a)}]NH_2$$

wherein

R is a $C_1$–$C_{20}$ alkyl, alkaryl, aralkyl, aryl, cycloalkyl, or alkenyl hydrocarbon group;

R′, R″ and R‴ are each a $C_2$–$C_5$ alkylene hydrocarbon group;

a is an integer 0–1;

x is 1–20; and y is 1–20.

37. A composition comprising the reaction product of a maleic acid anhydride and an amine having the formula:

$$R(OR')_xNHR''NH_2$$

wherein

R is a $C_1$–$C_{20}$ alkyl, alkaryl, aralkyl, aryl, cycloalkyl, or alkenyl hydrocarbon group;

R′ is a $C_2$–$C_5$ alkylene hydrocarbon group;

R″ is a $C_2$–$C_5$ alkylene hydrocarbon group; and x is 1–20.

38. A composition comprising the reaction product of maleic acid anhydride and tridecyl oxypropyl amino isopropyl amine.

39.

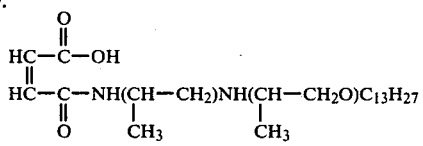

40. A composition comprising the reaction product of a maleic acid anhydride and an amine having the formula:

$$R(OR')_x(OR''')_yNH_2$$

wherein

R is a $C_1$–$C_{20}$ alkyl, alkaryl, aralkyl, aryl, cycloalkyl, or alkenyl hydrocarbon group;

R′ and R″ are each $C_2$–$C_5$ alkylene hydrocarbon group; and x is 1–20.

41. A composition comprising the reaction product of a maleic acid anhydride and an amine:

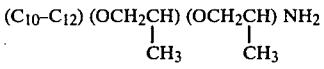

42.

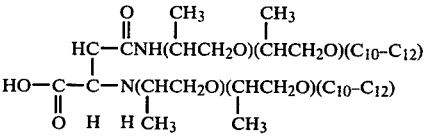

* * * * *